US005462681A

United States Patent [19]

Gutzmann et al.

[11] Patent Number: 5,462,681

[45] Date of Patent: Oct. 31, 1995

[54] PARTICULATE SUSPENDING ANTIMICROBIAL ADDITIVES

[75] Inventors: Timothy A. Gutzmann, Eagan; Mark R. Altier, St. Paul, both of Minn.

[73] Assignee: Ecolab, Inc., St. Paul, Minn.

[21] Appl. No.: 150,951

[22] Filed: Nov. 12, 1993

[51] Int. Cl.[6] ..... C10M 129/08; C10M 173/02

[52] U.S. Cl. ..... 252/11; 252/49.3; 252/50; 252/51; 252/56 R

[58] Field of Search ..... 252/544, 546, 252/547, 49.3, 11, 56 R, 50, 51

[56] References Cited

U.S. PATENT DOCUMENTS

| | | | |
|---|---|---|---|
| Re. 30,885 | 3/1982 | Rieder | 252/34 |
| 2,921,828 | 1/1960 | Caldwell | 8/4 |
| 3,186,946 | 6/1965 | Sluhan | 252/49.3 |
| 3,336,225 | 8/1967 | Sayad et al. | 252/34.7 |
| 3,350,346 | 10/1967 | Maxson | 260/45.7 |
| 3,352,787 | 11/1967 | Bodach | 252/108 |
| 3,372,117 | 3/1968 | Jones et al. | 252/42.1 |
| 3,374,171 | 3/1968 | Davis | 252/34.7 |
| 3,425,940 | 2/1969 | Norton | 252/8.5 |
| 3,507,792 | 4/1970 | Zuraw | 252/49.5 |
| 3,574,100 | 4/1971 | Wetmore | 252/32.5 |
| 3,583,914 | 6/1971 | Garvin | 252/34.7 |
| 3,672,977 | 6/1972 | Dardoufas | 117/138.8 |
| 3,718,588 | 2/1973 | Bellos et al. | 252/32.5 |
| 3,802,912 | 4/1974 | Otocka | 117/118 |
| 3,860,521 | 1/1975 | Aepli et al. | 252/34.7 |
| 3,882,038 | 5/1975 | Clayton et al. | 252/164 |
| 3,950,258 | 4/1976 | Imai et al. | 252/33 |
| 3,960,742 | 6/1976 | Leonard | 252/90 |
| 4,173,669 | 11/1979 | Ashida et al. | 428/35 |
| 4,264,479 | 4/1981 | Flanagan | 252/524 |
| 4,274,973 | 6/1981 | Stanton et al. | 252/34.7 |
| 4,311,250 | 1/1982 | Ravve et al. | 220/458 |
| 4,321,277 | 3/1982 | Saurino | 424/329 |
| 4,328,108 | 5/1982 | Deeken | 252/8.6 |
| 4,390,436 | 6/1983 | Hernandez | 252/49.3 |
| 4,390,439 | 6/1983 | Schwartz et al. | 252/73 |
| 4,419,251 | 12/1983 | Shim et al. | 252/32.7 E |
| 4,486,324 | 12/1984 | Korosec | 252/49.3 |
| 4,497,715 | 2/1985 | Bauman | 252/8.8 |
| 4,521,321 | 6/1985 | Anderson et al. | 252/49.3 |
| 4,529,761 | 7/1985 | Lohmeijer | 524/157 |
| 4,539,125 | 9/1985 | Sato | 252/32.7 E |
| 4,563,288 | 1/1986 | Bauman | 252/8.8 |
| 4,604,220 | 8/1986 | Stanton | 252/49.3 |
| 4,668,422 | 5/1987 | Malik et al. | 252/174.17 |
| 4,681,906 | 7/1987 | Abolins et al. | 524/166 |
| 4,759,861 | 7/1988 | Ogura et al. | 252/33 |
| 4,769,162 | 9/1988 | Remus | 252/18 |
| 4,778,614 | 10/1988 | Rawlinson et al. | 252/49.5 |
| 4,787,995 | 11/1988 | Nichols et al. | 252/49.5 |
| 4,802,998 | 2/1989 | Mueller et al. | 252/8.514 |
| 4,830,782 | 5/1989 | Broze et al. | 252/545 |
| 4,839,067 | 6/1989 | Jansen | 252/11 |
| 4,839,067 | 6/1989 | Jansen | 252/11 |
| 4,894,402 | 1/1990 | Abolins et al. | 524/157 |
| 4,929,375 | 5/1990 | Rossio et al. | 252/49.3 |
| 5,009,801 | 4/1991 | Wider et al. | 252/33.2 |
| 5,062,978 | 11/1991 | Weber et al. | 252/49.3 |
| 5,062,979 | 11/1991 | Scharf et al. | 252/49.3 |
| 5,073,280 | 12/1991 | Rossio et al. | 252/49.3 |
| 5,182,035 | 1/1993 | Schmidt et al. | 252/34 |

FOREIGN PATENT DOCUMENTS

| | | |
|---|---|---|
| 1068378 | 5/1967 | United Kingdom . |
| 9213048 | 8/1992 | WIPO . |
| 9213050 | 8/1992 | WIPO . |
| 9318120 | 9/1993 | WIPO . |

OTHER PUBLICATIONS

Database WPI Section Ch, Week 9014, Derwent Publications Ltd., London, GB; Class D22, AN 90–104332 & JP,A,2 055 794 (Asahi Chemical Ind KK) 26 Jan. 1990.

Database WPI Section Ch, Week 8444 Derwent Publications Ltd., London, GB; Class D25, AN 84–275127 & SU,A,1 079 662 (Chem Ind Res Pln In) 15 Mar. 1984.

General Mills, Deriphats, Chemical Division, Bulletin 15–A (Date unavailable).

*Primary Examiner*—Jacqueline V. Howard

*Attorney, Agent, or Firm*—Merchant, Gould, Smith, Edell, Welter & Schmidt

[57] ABSTRACT

The invention is a particulate suspending, antimicrobial concentrate composition. The concentrate may be used in any number of environments including food service and processing environments such as brewing and bottling facilities. Generally the concentrate may be entrained in a product or introduced directly into the environment of use. The concentrate generally comprises an antimicrobial cationic compound such as a quaternary ammonium compound, and a particulate suspending surfactant such as an amphoteric propionic acid salt.

16 Claims, No Drawings

PARTICULATE SUSPENDING ANTIMICROBIAL ADDITIVES

FIELD OF THE INVENTION

The invention relates generally to chemical compositions which when added to a carrier increase the antimicrobial and suspension character of the entire composition. More specifically, the invention relates to an additive composition which, when added to a closed or open system, provides increased suspension properties and an antimicrobial character within the system to which it has been added.

BACKGROUND OF THE INVENTION

The nature of the environment in which products are manufactured, formulated, or otherwise prepared may vary tremendously depending upon the product being provided. However, in most instances the production environment is the result of a studied effort to efficiently and safely produce a product which meets or exceeds the consumers demands for quality. Generally, efforts towards heightened efficiency and safety are ongoing, typified by a continuing attempt to increase levels of economy and efficiency, production, product quality, and hygiene.

Unfortunately, the nature of certain production environments produces problems on an almost continual basis which can impact the product. These problems may result in or otherwise require severe remedies, especially when the ultimate product is one destined for human contact or consumption, such as for example, personal care products or food products, respectively. The application of remedial action may further be exacerbated by the nature of the system. For example, cleaning a closed system of tanks and pipeline used to process dairy products, fruit beverages, carbonated beverages, or brewed beverages (beer) may present a formidable task.

One example of such a production problem occurs in the brewing industry. Brewing malt beverages including the precursor products, as well as all the processing steps leading to bottling, result in sediment formation in the processing environment. The difficulty in removing this sediment from the processing environment often requires heightened remedial action to maintain product quality and hygiene.

This build up of precipitate is commonly called "black soil" or sludge. Chemically it is generally a complex mixture of the amine acetate components of the lubricant, a number of components found in beer and usually contains metals such as iron, chromium and nickel. The beer components found include sulfates, phosphates, carbonates, proteins and hops resins. It is thought that the reaction with the inorganic beer components (sulfates, phosphates, carbonates) may be the primary constituent of the soil. The precipitate itself is white or tan in color. The metals in the system combine with the beer and lube precipitate, and the amine acetate components of the lubricant are not able to provide the necessary lubricity. As a result, the friction on the sliding metal contacts increases further and wear increases releasing metal particles which then combine with the tan precipitate to form the black soil. The precipitate may form or settle in processing lines, making it difficult to remove and a constant threat to product clarity, quality and overall safety.

Previously, attempts at removing or otherwise purging the system of precipitate have included filtering and flushing. However, these techniques often require and generate high volumes of by-product, may also slow production, and provide a relatively low level of cleaning and antimicrobial efficacy.

As a result, there is a need to provide a commercially viable means of suspending waste particulates in fluid systems to facilitate removal while simultaneously increasing system hygiene through antimicrobial action.

SUMMARY OF THE INVENTION

In accordance with a first aspect of the invention there is provided a particulate suspending concentrate composition for use with a diluent. The concentrate generally comprises an antimicrobial cationic compound, and a soil suspending surfactant. In accordance with a further aspect of the invention there is also provided products comprising the concentrate of the invention and carrier system treated with the concentrate of the invention.

The invention improves the performance of the base product to which it is added. The performance properties improved typically include improved soil suspension, decreased sludge formation, improved lubricity and less metal to metal contact wear as well as improved antimicrobial efficacy. Other performance properties may also improve depending on the primary nature of the base product. In the case of a conveyor lubricant, lubricity may improve.

Among other benefits, the invention solves a problem encountered in the brewery market. Lubricant compositions, when applied to beer bottle conveying systems, provide lubricity and cleaning properties. However, when certain lubricants (such as amine acetates) come in contact with beer spillage, which is very common in the container filing areas, the lubricity and cleaning performance decreases substantially. This due to the fact that the beer reacts with certain lubricant components and forms a precipitate which adheres to the conveying structure. The precipitate is difficult to remove and will build up on the conveying structure. The invention facilitates suspension and removal of this precipitate thereby solving this problem.

DETAILED DESCRIPTION OF THE INVENTION

The invention is a soil suspending concentrate composition for use with a diluent or carrier product. The concentrate generally comprises an antimicrobial compound and a particulate suspending surfactant.

A. Antimicrobial Compounds

The antimicrobial compound used in the antimicrobial lubricant compositions of the invention contributes effective antimicrobial or germicidal action to the composition by reducing microbe populations. Generally, the cationic antimicrobial compound should be susceptible to dissolution or dispersion in an aqueous medium without significant degradation, precipitation, and/or phase separation over extended periods of time when used in the composition.

A wide variety of effective antimicrobial compounds may be incorporated into the antimicrobial lubricant composition of the invention without inducing undesirable physical or chemical interactions between the major components of the composition. The preferred antimicrobial compounds are the highly effective quaternary ammonium compounds having the formula $(R^1)(R^1)(R^3)(R^4)N+X—$ wherein $R^1$, $R^2$, $R^3$, and $R^4$ are independently a $C_{1-24}$ aliphatic group, a $C_{1-14}$ hydroxyaliphatic group, benzyl, $C_{1-24}$ alkyl benzyl, or halo benzyl, and X- represents an anion capable of imparting water solubility or dispersibility to the compound such as chloride, bromide, iodide, sulfate, methylsulfate, and others. This anion is linked to the nitrogen through an electrovalent bond.

The hydrocarbon substituents $R^1$, $R^2$, $R^3$, and $R^4$ may be alike or different, substituted or unsubstituted, branched or unbranched, and saturated or unsaturated. In somewhat greater detail, the hydrocarbon substituents $R^1$, $R^2$, $R^3$, and $R^4$ may be independently selected from hydrocarbon groups including specifically, but not exclusively: lower alkyl groups such as methyl, ethyl, propyl and butyl; higher alkyl groups such as pentyl, hexyl, heptyl, 2-ethylhexyl, octyl, isooctyl, nonyl, decyl, unidecyl, dodecyl, tetradecyl, and eicosyl; substituted lower alkyl groups such as hydroxyethyl and hydroxypropyl; lower alkenyl groups such as ethenyl, propenyl, and butenyl; lower alkynyl groups such as ethynyl, propenyl, and butynyl; cycloalkyl groups such as cyclohexyl; aryl groups such as benzyl, phenyl and naphthyl; and aralkyl/alkaryl groups such as tolyl, xylyl, alkyl substituted benzyl, and alkylnaphthyl.

Several theories have been proposed to explain the mechanism by which the quaternary ammonium compounds are able to deactivate the microorganisms such as bacteria. One theory suggests that the bactericidal effect is achieved because of the ability of quaternary ammonium compounds to chemically disrupt continuity of the cell walls of the microorganism and thereby cause a release of the cell contents into the surrounding medium. A second theory suggests that quaternary ammonium compounds interact with the cell walls of the microorganism and interfere with the metabolic processes of the organism so as to starve the microorganism. Whatever the exact mechanism, experience suggests that the antimicrobial action is closely related to the surface activity of the quaternary ammonium compound.

It is a well recognized principle that the surface activity of a compound in an aqueous environment is effected by the presence of both a hydrophilic and a hydrophobic moiety on the compound. Since quaternary ammonium compounds inherently hydrophilic in nature due to their cationic structure, the amphipathic characteristic of the compound must be achieved by providing at least one pendant hydrocarbon group which is effective for providing a hydrophobic group on the compound.

While several factors can affect the overall antimicrobial performance of the quaternary ammonium compound such as the other components present in the antimicrobial lubricant composition and the particular microbes present, optimum antimicrobial activity appears to occur when the hydrocarbon substituents on the quaternary ammonium compound contain about 16 carbon atoms.

Generally speaking, completely aliphatic quaternary ammonium compounds appear to provide optimal antimicrobial activity when the largest aliphatic group is a straight chain $C_{16-18}$ group and benzyl quaternary ammonium compounds appear to provide optimal antimicrobial activity when the largest aliphatic group is a straight chain $C_{14}$ group.

A large variety of surface active quaternary ammonium salts are useful as the antimicrobial compound in the antimicrobial lubricant compositions of the invention including the commonly available tetraalkyl quaternary ammonium chlorides, trialkyl benzyl quaternary ammonium chlorides and trialkyl alkylbenzyl quaternary ammonium chlorides all having a largest aliphatic group having about 12 to about 16 carbon atoms. Neat concentrations of these quaternary ammonium chlorides are generally viscous liquids but usually sold as aqueous solutions.

Preferred quaternary ammonium salts which can be used as the antimicrobial compound in the antimicrobial lubricant compositions of the invention include specifically, but not exclusively, ($C_{8-24}$) alkyl-trimethyl quaternary ammonium salts such as hexadecyl-trimethyl quaternary ammonium chloride and octadecyl-trimethyl quaternary ammonium chloride; ($C_{8-24}$) dialkyl dimethyl quaternary ammonium compounds such as didecyl-dimethyl quaternary ammonium chloride; alkyl-aryl quaternary ammonium salts such as ($C_{8-24}$) alkyl-dimethyl-benzyl quaternary ammonium chloride, ($C_{8-24}$) alkyl-dimethylbenzalkonium chloride, and dimethyldichlorobenzyl quaternary ammonium chloride; and various others such as hexadecyl-pyridinium chloride, benzethonium chloride and methylbenzethonium chloride.

Highly preferred quaternary ammonium compound for use in the antimicrobial lubricant compositions of the invention are the ($C_{8-24}$) alkyl-dimethyl-benzyl quaternary ammonium chlorides having the general formula:

$$(C_6H_5CH_2)(CH_3)_2(R^1)N^+Cl^-$$

wherein $R^1$ is a $C_{6-24}$ alkyl.

Particularly preferred is a mixture of ($C_{8-18}$) alkyldimethyl-benzyl quaternary ammonium chlorides having predominately (i.e. more than 50 mole %) $C_{12}$ alkyl groups.

Generally, in order to provide the preferred antimicrobial activity the concentrate formulation of the invention may comprise from about 0.01 wt-% to 25 wt-%, preferably 0.5 wt-% to 10 wt-%, and most preferably 1 wt-% to 5 wt-% cationic antimicrobial compound. These concentrations of cationic compound have also been found to assist in providing a preferred level of soil suspension.

Generally, exceeding these concentration levels will provide little increased benefit in antimicrobial action and may impair lubricity. Reducing the concentration below these levels may reduce the antimicrobial effect of the composition.

B. Suspending Agents

The composition of the invention also comprises a particulate suspending agent to assist in the removal of precipitates, soil, particulates, etc. which may result as a byproduct from the production process. The inclusion of such constituents is especially important in closed systems, such as clean-in-place systems that cannot be disassembled or otherwise exposed to remove particulate waste. In these systems, particulates which are not suspended may be continually reflushed through the system only to act as a particulate contaminant, incidentally finding residence in the product.

Any number of compounds, polymers, etc. may be used in accordance with the suspending action of the invention. Inorganic and organic compounds may be used as well as any number of polymer compositions. Of special preference are compounds, monomers, and polymers which alter the surface tension of the diluent or carrier.

One specific class of surface tension altering agents are commonly referred to as surfactants. Surfactants are generally defined by the electrical charge carried by the specific compound. For example, cationic surfactants such as mono-, di-, and polyamines, imidazolines, and quaternary ammonium salts carry a positive charge. Anionic surfactants such as carboxylates, sulfonates, sulfates, and protein hydrosylates carry a negative charge. Nonionic surfactants such as those derived from carboxylic acids, amides and esters, as well as polyalkylene oxides carry no ionic charge. Zwitterionic or amphoteric surfactants carry both a negative and a positive charge.

Each of these classes of surfactants may be useful in suspending particulates in accordance with the invention. Especially preferred surfactants include zwitterionic or amphoteric surfactants.

Amphoteric surfactants contain both cationic and anionic groups. In the preferred amphoteric surfactants, the cationic center is either a secondary or a tertiary amine group, depending on whether the molecule is a mono- or di-propionate. The anionic properties are provided by the carboxylate group or groups. Changing the pH of the environment in which the amphoteric surfactants is placed alters the electro chemical state of the surfactant. Generally, the unshared electron pair on the nitrogen is capable of accepting a proton in acid solution by formation of a coordinate covalent bond. This acquired proton imparts a positive charge to the molecule. In acidic solution (such as HCl), the amphoteric is a cationic amine salt. In an alkaline solution (such as NaOH), the amphoteric surfactant is an anionic carboxylate salt.

A representative listing of amphoteric surfactants include N-coco-3-aminopropionic acid and acid salts, N-tallow-3-iminodiproprionate salts. As well as N-lauryl-3-iminodiproprionate disodium salt, N-carboxymethyl-N-cocalkyl-N-dimethylammonium hydroxide, N-carboxymethyl-N-dimethyl-N-(9-octadecenyl) ammonium hydroxide, (1-carboxyheptadecyl) trimethylammonium hydroxide, (1-carboxyundecyl) trimethylammonium hydroxide, N-cocoamidoethyl-N-hydroxyethylglycine sodium salt, N-hydroxyethyl-N-stearamidoglycine sodium salt, N-hydroxyethyl-N-lauramido-β-alanine sodium salt, N-cocoamido-N-hydroxyethyl-β-alanine sodium salt, as well as mixed alicyclic amines, and their ethoxylated and sulfated sodium salts, 2-alkyl-1-carboxymethyl-1-hyroxyethyl-2-imidazolinium hydroxide sodium salt or free acid wherein the alkyl group may be nonyl, undecyl, or heptadecyl. Also useful are 1,1-bis(carboxymethyl)-2-undecyl-2-imidazolinium hydroxide disodium salt and oleic acid-ethylenediamine condensate, propoxylated and sulfated sodium salt. Amine oxide amphoteric surfactants are also useful. This list is by no means exclusive or limiting.

Preferred amphoteric surface active agents contain both carboxyl and amino functionality in their structure. These surfactants may generally be prepared by the condensation of fatty primary amines and acrylic monomers. Available products include salts and free acids of both the N-fatty aminopropionates and the N-fatty iminodipropionates.

The performance of the particulate suspending compound may depend on the pH of solution, the chain length of the fatty portion of the molecule, and the ampholytic balance or the ratio of carboxyl to amino polar centers in the compound used. This latter property (in addition to chain length selection) imparts an ability to vary the hydrophile lipophile balance.

Generally, to obtain the most desirable effects the pH of the composition should range from about 5 to 9, preferably about 6 to 8, and most preferably about 7. Further, the chain length of the fatty portion of the amphoteric molecule will affect surface activity, solubility, detergency and lubricity among other properties.

The chain length may range from about $C_6$ to $C_{20}$, preferably about $C_{10}$ to $C_{16}$ and most preferably be a mixture of $C_{12}$ and $C_{14}$. The chain length of the amphoteric affects solubility, compatibility, detergency, foaming power and surface activity. For example, coco and lauryl amphoterics basically $C_{12}$, are more soluble in water, exhibit broader compatibility with other compounds and foam better than tallow amphoterics ($C_{18}$). Too small a chain length may result in poor surface activity, suspending ability, and lubricity. Extending the chain length beyond that specified above may result in poor solubility.

Finally, the ampholytic balance of the molecule is preferably balance, through pH, to provide more anionic character thereby increasing the bonding ability of the molecule to surfaces and, in turn, increasing lubricity.

Further, amphoterics that contain two carboxyl groups are more soluble in water and somewhat lower in detergency and foaming than monocarboxyl amphoterics. The compatibility of these amphoterics with other compounds is also greater and they are able to solubilize organic and inorganic additives in surfactant formulations. Generally, preferred amphoterics include N-fatty amino propionate and N-fatty amino dipropionate.

Generally, the concentration of particulate suspending constituent generally comprises from about 0.1 wt-% to 30 wt-%, preferably 0.5 wt-% to 10 wt-%, and most preferably 1 wt-% to 5 wt-% of the concentrate composition of the invention to impart ready particulate suspending characteristics and assist in increasing the antimicrobial nature of the composition.

C. The Carrier

The composition of the invention may also comprise a carrier. The carrier within this composition functions to transport the antimicrobial particulate suspending agents to the intended area, volume, or surface of application and define the forms of the composition. Moreover, depending upon the nature of the carrier, this constituent may be used to provide other properties, attributes, or characteristics within the point of application. For example, the carrier may impart physical shape or form to the composition. Further, the carrier may comprise a product in its own right such as a lubricant, CIP cleaner, or hard surface sanitizer, as examples.

The composition of the invention may take the form of a liquid concentrate, semisolid or solid. Accordingly, the choice of any carrier useful in the invention will depend somewhat on the intended form and intended use application of the final composition. If the invention takes the form of a solution, semisolid, or solid, useful carriers include water or aqueous systems as well as organic or inorganic based carriers, or mixtures thereof.

Organics which have been found especially useful include simple alkyl alcohols such as ethanol, isopropanol, n-propanol and the like. Polyols are also useful carriers in accordance with the invention, including propylene glycol, polyethylene glycol, glycerol, sorbitol and the like. Any of these compounds may be used singly or in combination with another organic or inorganic carrier or, in combination with water, or in mixtures thereof.

If organic, the carrier may also comprise any number of surfactants or surfactant combinations. Surface active agents which have been found as useful carrier in accordance with the invention include anionic and nonionic agents such as, for example, propylene glycol esters, glycerol esters, polyoxyethylene glycerol esters, polyglycerol esters, sorbitan esters, polyoxyethylene sorbitan esters, sucrose esters, polyethylene glycol esters, polyoxyethylene-polyoxypropylene ether adducts, dioctyl sodium succinate, stearoyl lactylate, and esters of acetylated, lactylated, citrated, succinylated or diacetyl tartarated glycerides.

Preferred surfactants include nonionic surfactants having a mixture of polyoxyethylene and polyoxypropylene moieties. Specifically, one nonionic surfactant found to be especially preferred is a polyoxyethylene, polyoxypropylene block copolymer having about 240 to 280 moles of ethoxylation and about 45–65 moles of propoxylation.

If the invention is formulated as a solid, the carrier may selected from any organic or inorganic compound which imparts a solid form and hardness to the composition of the invention either by a hot-melt, pourcast process, by extrusion, or by compression. Typical organic ingredients which may be used in the solid antimicrobial composition of the invention to harden this composition include amides, polyols, and certain nonionic and anionic surfactants.

For example, stearic monoethanol amide, stearic diethanol amide and urea have been found to effectively result in the formulation of a hardened product. Moreover, polyols such as polyethylene glycol, and polyhydric sugar alcohols such as mannitol and the like or mixtures thereof have all been found to impart a hardened but soluble character when combined in the composition of the invention.

Surfactants useful in this invention as a hardening agent and carrier are solid, generally high melting analogs of nonionics and anhydrous metallic salts of anionic surfactants which include nonyl phenol ethoxylates, linear alkyl alcohol ethoxylates, ethylene oxide/propylene oxide block copolymers, glycerol esters, polyoxyethylene glycerol esters, polyglycerol esters, sorbitan esters, polyoxyethylene sorbitan esters, sucrose esters, polyethylene ethers, dioctyl sodium sulfo succinate, stearoyl lactylate, and complex esters such as acetylated, lactylated, citrated, succinylated, and diacetyl tartarated glycerides.

Other compositions which may be used as hardeners within the composition of the invention include salts formed of Periodic Groups IA and IIA metals, as well as ammonium, with the corresponding negative ions or radicals of mineral acids such as chloride ions, carbonate ions, nitrate ions, phosphate ions, and sulphate ions as well as their respective hydrates, protic salt forms, or in the case of phosphates, the various condensate species.

Generally, any type of carrier capable of solidifying the antimicrobial particulate suspending agents may be used in accordance the invention. However, preferably, the solidifying agent is urea, Pluronic TM F-108 and polyethylene glycol have been found to be beneficial solidifying agents.

Generally, the carrier comprises a large, if not major, portion of the composition of the invention. Here again, the carrier concentration and type will depend upon the nature of the composition as a whole, the environment of storage and method of application including the concentration of particulate suspending antimicrobial agents, among other factors. Notably, the carrier should be chosen and used at a concentration which does not inhibit the antimicrobial or particulate suspending efficacy of the actives in the composition of the invention.

| | PREFERRED | MORE PREFERRED | MOST PREFERRED |
|---|---|---|---|
| Antimicrobial Agent | 0.1–25% | 0.5–10% | 1–5% |
| Particulate Suspending Agent | 0.1–30% | 0.5–10% | 1–5% |
| Carrier | Balance | Balance | Balance |

In this instance, the carrier may comprise a product such as a lubricant or hard surface cleaner or, in the alternative, an adjuvant useful in providing a desired form (e.g. solid, semi-solid, or liquid).

DILUTION SUMMARY

Generally, the dilution of the concentrate will vary depending upon the application in which it is applied. However, the following guidelines for dilution (upon final concentration) provide a generally preferable level of antimicrobial and soil suspending efficacy.

| | Antimicrobial Agent PPM* | Particulate Suspending Agent PPM* |
|---|---|---|
| Preferred | 5–2500 | 5–3000 |
| More Preferred | 25–1000 | 25–1000 |
| Most Preferred | 50–500 | 50–500 |

*(PPM of constituent in carrier)

APPLICATIONS

Generally, the concentrate composition of the invention may be introduced directly into a system or into any number of products, diluents or carriers, as well as environments of use in the form of liquid, semisolid or solid products which are later used in a liquid, diluent form. Exemplary areas of application include ware washing, laundry and textile care, kitchen and housekeeping applications, food applications, products used in dairy and food preparation environments, as well as janitorial products such as floor care products and disinfectants, among other applications.

Exemplary products in which the concentrate of the invention can be used include solid, semi-solid, and liquid products such as sanitizers including carboxylic acid sanitizers, peroxy acid sanitizers, iodine sanitizers, quaternary sanitizers, phenolic sanitizers, acid-anionic sanitizers, and mixtures thereof; lubricants including conveyer lubricants such as those based upon mono-, di-, and polyamines, quaternary salts, fatty acids, as well as salts and mixtures of these constituents; wash chemicals such as alkaline and caustic cleaners, caustic and neutral CIP cleaners, acidic and acid based detergents, and foam cleaners as well as mixtures thereof; rinse chemicals such as nonionics, ureas, amides, and mixtures thereof; and laundry chemicals such as surfactant and alkaline based wash chemicals, inorganic and organic based wash chemicals including phosphates and phosphonates, softening agents, including quaternary salts as well as mixtures thereof.

Hereagain, the concentration of the concentrate of the invention may vary depending upon the ultimate application. However, the actual volume of concentrate added directly to the system or added into any one of the preceding products may be varied depending upon the ultimate dilution desired in the final product.

Preferred applications include conveyer lubricants, clean-in-place compositions, and hard surface cleaners. More preferred applications include conveyer lubricants containing amine acetates such as those disclosed in Caldwell, U.S. Pat. No. 2,921,828; Sluhan, U.S. Pat. No. 3,186,946; Sayad et al., U.S. Pat. No. 3,336,225; Maxson, U.S. Pat. No. 3,350,346; Bodach, U.S. Pat. No. 3,352,787; Jones et al., U.S. Pat. No. 3,372,117; Davis, U.S. Pat. No. 3,374,171; Norton, U.S. Pat. No. 3,425,940; Zuraw, U.S. Pat. No. 3,507,792; Wetmore, U.S. Pat. No. 3,574,100; Garvin et al., U.S. Pat. No. 3,583,914; Dardoufas, U.S. Pat. No. 3,672,977; Bellos et al., U.S. Pat. No. 3,718,588; Otocka, U.S. Pat. No. 3,802,912; Aepli et al., U.S. Pat. No. 3,860,521; Imai et al., U.S. Pat. No. 3,950,258; Ashida et al., U.S. Pat. No. 4,173,669; Stanton et al., U.S. Pat. No. 4,274,973; Ravve et al., U.S. Pat. No. 4,311,250; Rieder, U.S. Pat. No. Re.

30,885; Deeken, U.S. Pat. No. 4,328,108; Hernandez, U.S. Pat. No. 4,390,436; Schwartz et al., U.S. Pat. No. 4,390,439; Shim et al., U.S. Pat. No. 4,419,251; Korosec, U.S. Pat. No. 4,486,324; Anderson et al., U.S. Pat. No. 4,521,321; Lohmeijer, U.S. Pat. No. 4,529,761; Sato, U.S. Pat. No. 4,539,125; Stanton, U.S. Pat. No. 4,604,220; Abolins et al., U.S. Pat. No. 4,681,906; Ogura et al., U.S. Pat. No. 4,759,861; Remus, U.S. Pat. No. 4,769,162; Rawlinson et al., U.S. Pat. No. 4,778,614; Nichols et al., U.S. Pat. No. 4,787,995; Mueller et al., U.S. Pat. No. 4,802,998; Jansen, U.S. Pat. No. 4,839,067; Abolins et al., U.S. Pat. No. 4,894,402; Rossio et al., U.S. Pat. No. 4,929,375; Wider et al., U.S. Pat. No. 5,009,801; Weber et al., U.S. Pat. No. 5,062,978; Weber et al., U.S. Pat. No. 5,062,979; and Rossio et al., U.S. Pat. No. 5,073,280 all of which are incorporated herein by reference.

WORKING EXAMPLES

The following working examples are provided to exemplify the concentrate composition of the invention. However, while these examples are intended to illustrate the invention, they are not intended to be construed as limiting of the invention.

WORKING EXAMPLE 1

Four test formulas were produced in the lab as follows:

| Example | 1A | 1B | 1C | 1D |
|---|---|---|---|---|
| Distilled Water | 70.70% | 65.70% | 64.70% | 59.70% |
| Acetic Acid 100% | 4.80 | 4.80 | 4.80 | 4.80 |
| Duomeen CD (N-coco-1,3-diaminopropane) | 6.00 | 6.00 | 6.00 | 6.00 |
| Duomeen OL (N-oleyl-1,3-diaminopropane) | 6.00 | 6.00 | 6.00 | 6.00 |
| Varonic K215 (N-coco amine ethoxylate, 15 mole) | 2.00 | 2.00 | 2.00 | 2.00 |
| Triethanolamine 99% | 1.50 | 1.50 | 1.50 | 1.50 |
| Isopropyl Alcohol | 9.00 | 9.00 | 9.00 | 9.00 |
| Deriphat 160C (Laurylimino-diproprionic acid, mono sodium salt) | — | 5.00 | — | 5.00 |
| Q-372 (Coco-alkyldimethyl-benzyl ammonium chloride) | — | — | 6.00 | 6.00 |

To evaluate lubricity and soil suspension a Falex lubricity test was conducted. The Falex Lubricity Tester uses a rotating pin to which a load is applied through two blocks (Vee Blocks). This load causes a rotational torque which is directly proportional to the coefficient of friction, a measure of lubricity. This measured torque is used to compare relative lubricities of test formulas. The Falex Tester also provides an indication of the anti-wear properties of the test formula as a function of the number of "teeth" that the ratchet wheel is advanced during the test run. Soil suspension is determined by observing the test solution over a period of time.

The basic Falex procedure is al follows:

1. Load Falex tester with a mild steal pin and a v-block set.

2. Make 1 liter of test solution and place in 2 liter beaker with an agitator.

3. Place recirculation cup under v-block journal and start recirculation pump. Recirculate at about 100 ml/min.

4. Start the Falex tester and ratchet the load gage up to 50 lbs.

5. Run for 5 minutes at 50 lbs load. Record torque and solution temperature.

6. Ratchet the load gage up to 200 lbs and run for 60 minutes.

7. Record the torque, solution temperature and ratchet wheel teeth at 0, 30 and 60 minutes.

8. Record total number of teeth (wear).

9. Pour test solution into 1 liter glass jar and record solution clarity and amount of sludge.

10. Check test solution at approximately 4–6 hours and at about 24 hours. Compare base formula to base samples with additives.

The four test formulas were evaluated using the Falex procedure. The test formulas were then tested at 0.25% in both a 50:50 beer/water mixture and in water only. The results indicated that the lubricity and wear properties improve with the additives. Also with the additives the amount of black soil (sludge) formed is lower and what sludge does form, stays suspended longer. Because there is less sludge formed and it stays suspended longer the soil build up on the conveyor structure will be less as the soil can be easily flushed from the surface by the normal fluid flow over the structure surface.

| | 50:50 Beer/Water | | | |
|---|---|---|---|---|
| Example | 1A | 1B | 1C | 1D |
| Test Concentration | 0.25% | 0.25% | 0.25% | 0.25% |
| Final Torque* | 5.8 inlb | 4.0 inlb | 3.8 inlb | 5.3 inlb |
| Total Teeth** | 17 | 8 | 0 | 14 |
| Initial Clarity*** | 4 | 3 | 2 | 2 |
| Initial Sludge**** | 4 (about ⅛) | 2 (trace) | 1 (none) | 1 (none) |
| Clarity @ 15 hours | 1–2 | 2–3 | 3 | 3 |
| Sludge @ 15 hours | 4 (+⅛") | 3(about 1/16") | 2(trace) | 1 (none) |

*Torque: Lower torque indicates better lubricity.
**Total Teeth: Fewer teeth indicates lower metal contact wear.
***Clarity Rating: 1 = clearest, 2 = slightly turbid, 3 = turbid, 4 = slightly opaque, 5 = very opaque
****Sludge Rating: 1 = no sludge, 2 = trace, 3 = 1/16", 4 = ⅛", 5 > = ¼"

ANTIMICROBIAL TESTING

Two sets of antimicrobial testing was undertaken using the compositions formulated in Example 1 to determine the sanitizing and/or disinfecting efficacy of these compositions.

A sanitizer is an agent that reduces the number of bacterial contaminants to safe levels as judged by public health requirements. Practically, a sanitizer must result in 99.999% reduction (5 log order reduction) for given organisms as defined by Germicidal and Detergent Sanitizing Action of Disinfectants, Official Methods of Analysis of the Association of Official Analytical Chemists, paragraph 960.09 and applicable sections, 15th Edition, 1990 (EPA Guideline 91-2).

A disinfectant is an agent that kills all vegetative cells including most recognized pathogenic microorganisms. As such it must pass a more stringent bactericidal test; the A.O.A.C. Use Dilution Methods, Official Methods of Analysis of the Association of Official Analytical Chemists, paragraph 955.14 and applicable sections, 15th Edition, 1990 (EPA Guideline 91-2).

Test #1

Four conveyor lubricants with the additives prepared in Example 1 were submitted for rate of kill testing with a mixed bacteria culture. Each sample was to be tested at 0.25% in sterile distilled water and at 0.25% in a 20% beer solution. Test temperature was to be ambient, with exposure times of 5, 15, 30, and 60 minutes.

Test Systems: Mixed culture of 3 ml each organism (24 hour broth culture)

| | |
|---|---|
| *Escherichia coli* | ATCC #11229 |
| *Enterobacter aerogenes* | ATCC #13048 |
| *Staphylococcus aureus* | ATCC #6538 |
| *Pseudomonas aeruginosa* | ATCC #15442 |

Inoculum=$1.5\times10^7$ CFU/ml

Test Substances:

| | |
|---|---|
| Example 1A | 0.25 ml into 99.75 ml sterile Milli-Q water |
| | 0.25 ml into 99.75 ml sterile 20% beer solution |
| Example 1B | 0.25 ml into 99.75 ml sterile Milli-Q water |
| | 0.25 ml into 99.75 ml sterile 20% beer solution |
| Example 1C | 0.25 ml into 99.75 ml sterile Milli-Q water |
| | 0.25 ml into 99.75 ml sterile 20% beer solution |
| Example 1D | 0.25 ml into 99.75 ml sterile Milli-Q water |
| | 0.25 ml into 99.75 ml sterile 20% beer solution |

Beer: Bud Light (Anheuser Busch)

Neutralizer: Chambers

Exposure Times: 5 minutes, 15 minutes, 30 minutes, and 60 minutes

Test Temperature: Ambient (about 22° C.)

Plating Media: TGE (Tryptone Glucose Extract agar)

Incubation Conditions: 37° C., 72 hours

Test #1 Results
Test #1 Example 1A

| Diluent | Exposure | Survivors/ ml | % log R | log R | pH |
|---|---|---|---|---|---|
| 0% beer | 5 min. | $<1.0\times10^1$ | >99.999 | >5.00 | 7.57 |
| | 15 min. | $<1.0\times10^1$ | >99.999 | >5.00 | |
| | 30 min. | $<1.0\times10^1$ | >99.999 | >5.00 | |
| | 60 min. | $<1.0\times10^1$ | >99.999 | >5.00 | |
| 20% beer | 5 min. | $7.9\times10^4$ | 99.473 | 2.28 | 6.23 |
| | 15 min. | $2.2\times10^3$ | 99.985 | 3.83 | |
| | 30 min. | $6.0\times10^1$ | >99.999 | >5.00 | |
| | 60 min. | $<1.0\times10^1$ | >99.999 | >5.00 | |

Test #1 Example 1B

| Diluent | Exposure | Survivors/ ml | % log R | log R | pH |
|---|---|---|---|---|---|
| 0% beer | 5 min. | $<1.0\times10^1$ | >99.999 | >5.00 | 7.44 |
| | 15 min. | $<1.0\times10^1$ | >99.999 | >5.00 | |
| | 30 min. | $<1.0\times10^1$ | >99.999 | >5.00 | |
| | 60 min. | $<1.0\times10^1$ | >99.999 | >5.00 | |
| 20% beer | 5 min. | $7.4\times10^4$ | 99.507 | 2.31 | 5.83 |
| | 15 min. | $6.5\times10^4$ | 99.567 | 2.36 | |
| | 30 min. | $3.0\times10^1$ | >99.999 | >5.00 | |
| | 60 min. | $<1.0\times10^1$ | >99.999 | >5.00 | |

-continued

Test #1 Example 1C

| Diluent | Exposure | Survivors/ ml | % log R | log R | pH |
|---|---|---|---|---|---|
| 0% beer | 5 min. | $<1.0\times10^1$ | >99.999 | >5.00 | 7.45 |
| | 15 min. | $<1.0\times10^1$ | >99.999 | >5.00 | |
| | 30 min. | $<1.0\times10$ | >99.999 | >5.00 | [1] |
| | 60 min. | $<1.0\times10^1$ | >99.999 | >5.00 | |
| 20% beer | 5 min. | $1.6\times10^4$ | 99.893 | 2.97 | 5.81 |
| | 15 min. | $2.0\times10^3$ | 99.987 | 3.89 | |
| | 30 min. | $1.0\times10^1$ | >99.999 | >5.00 | |
| | 60 min. | $<1.0\times10^1$ | >99.999 | >5.00 | |

Test #1 Example 1D

| Diluent | Exposure | Survivors/ ml | % log R | log R | pH |
|---|---|---|---|---|---|
| 0% beer | 5 min. | $<1.0\times10^1$ | >99.999 | >5.00 | 7.54 |
| | 15 min. | $<1.0\times10^1$ | >99.999 | >5.00 | |
| | 30 min. | $<1.0\times10^1$ | >99.999 | >5.00 | [1] |
| | 60 min. | $<1.0\times10^1$ | >99.999 | >5.00 | |
| 20% beer | 5 min. | $2.6\times10^4$ | 99.827 | 2.76 | 5.85 |
| | 15 min. | $6.0\times10^1$ | 99.999 | 3.89 | |
| | 30 min. | $1.0\times10^1$ | >99.999 | >5.00 | |
| | 60 min. | $<1.0\times10^1$ | >99.999 | >5.00 | |

Test #2

A second round of antimicrobial testing was undertaken to further analyze the efficacy of the invention. The four conveyor lubricants with the additives prepared in example 1 were submitted for rate of kill testing with a mixed bacteria culture. Each sample was tested at 0.25% in sterile water and at 0.25% in a 50% beer solution. The test temperature was ambient, with exposure times of 1, 5, 5, 30 and 60 minutes.

Test Systems: Mixed culture of 3 ml each organism (24 hour broth culture).

| | |
|---|---|
| *Escherichia coli* | ATCC #11229 |
| *Enterobacter aerogenes* | ATCC #13048 |
| *Staphylococcus aureus* | ATCC #6538 |
| *Pseudomanas aeruginosa* | ATCC #15422 |

Inoculum=$1.4\times10^7$ CFU/ml

Test Substances:

| | |
|---|---|
| Example 1A | 0.25 ml into 99.75 ml sterile Milli-Q water |
| | 0.25 ml into 99.75 ml sterile 50% beer solution |
| Example 1B | 0.25 ml into 99.75 ml sterile Milli-Q water |

-continued

| | |
|---|---|
| | 0.25 ml into 99.75 ml sterile 50% beer solution |
| Example 1C | 0.25 ml into 99.75 ml sterile Milli-Q water |
| | 0.25 ml into 99.75 ml sterile 50% beer solution |
| Example 1D | 0.25 ml into 99.75 ml sterile Milli-Q water |
| | 0.25 ml into 99.75 ml sterile 50% beer solution |

Beer: Bud Light (Anheuser Busch Inc.)

Neutralizer: Chambers

Exposures Times: 1, 5 and 15 minutes for sterile water. 1, 5, 15, 30, 60 minutes for the 50% beer solution.

Test Temperature: Ambient (about 22° C.)

Plating Media: TGE (Tryptone Glucose Extract agar)

Incubation Conditions: 37° C., 72 hours

Test #2 Results
Test #2 Example 1A

| Diluent | Exposure | Survivors/ml | % Log Reduction | Log Reduction | pH |
|---|---|---|---|---|---|
| 0% beer | 1 min. | $<1.0 \times 10^1$ | >99.999 | >5.00 | 7.04 |
| | 5 min. | $<1.0 \times 10^1$ | >99.999 | >5.00 | |
| | 15 min. | $1.6 \times 10^2$ | 99.999 | 4.94 | |
| 50% beer | 1 min. | $6.5 \times 10^6$ | 53.571 | <1.00 | 5.32 |
| | 5 min. | $2.7 \times 10^6$ | 80.714 | <1.00 | |
| | 15 min. | $1.1 \times 10^5$ | 99.214 | 2.10 | |
| | 30 min. | $4.2 \times 10^3$ | 99.970 | 3.52 | |
| | 60 min. | $4.4 \times 10^2$ | 99.997 | 4.50 | |

Test #2 Example 1B

| Diluent | Exposure | Survivors/ml | % Log Reduction | Log Reduction | pH |
|---|---|---|---|---|---|
| 0% beer | 1 min. | $2.2 \times 10^3$ | 99.984 | 3.80 | 7.22 |
| | 5 min. | $1.0 \times 10^1$ | >99.999 | >5.00 | |
| | 15 min. | $<1.0 \times 10^1$ | >99.999 | 5.00 | |
| 50% beer | 1 min. | $5.5 \times 10^6$ | 60.714 | <1.00 | 5.50 |
| | 5 min. | $4.9 \times 10^5$ | 96.500 | 1.46 | |
| | 15 min. | $2.2 \times 10^4$ | 99.843 | 2.80 | |
| | 30 min. | $1.1 \times 10^3$ | 99.992 | 4.10 | |
| | 60 min. | $<1.0 \times 10^1$ | >99.999 | >5.00 | |

Test #2 Example 1C

| Diluent | Exposure | Survivors/ml | % Log Reduction | Log Reduction | pH |
|---|---|---|---|---|---|
| 0% beer | 1 min. | $7.0 \times 10^1$ | >99.999 | >5.00 | 7.45 |
| | 5 min. | $<1.0 \times 10^1$ | >99.999 | >5.00 | |
| | 15 min. | $<1.0 \times 10^1$ | >99.999 | >5.00 | |
| 50% beer | 1 min. | $5.4 \times 10^6$ | 61.429 | <1.00 | 5.31 |
| | 5 min. | $3.0 \times 10^5$ | 97.857 | 1.67 | |
| | 15 min. | $7.0 \times 10^3$ | 99.950 | 3.30 | |
| | 30 min. | $2.0 \times 10^1$ | >99.999 | >5.00 | |
| | 60 min. | $<1.0 \times 10^1$ | >99.999 | >5.00 | |

Test #2 Example 1D

| Diluent | Exposure | Survivors/ml | % Log Reduction | Log Reduction | pH |
|---|---|---|---|---|---|
| 0% beer | 1 min. | $<1.0 \times 10^1$ | >99.999 | >5.00 | 7.47 |
| | 5 min. | $<1.0 \times 10^1$ | >99.999 | >5.00 | |
| | 15 min. | $<1.0 \times 10^1$ | >99.999 | >5.00 | |
| 50% beer | 1 min. | $5.0 \times 10^6$ | 64.285 | <1.00 | 5.33 |
| | 5 min. | $2.2 \times 10^5$ | 98.429 | 1.80 | |
| | 15 min. | $1.2 \times 10^3$ | 99.991 | 4.07 | |
| | 30 min. | $1.0 \times 10^1$ | >99.999 | >5.00 | |
| | 60 min. | $1.0 \times 10^2$ | >99.999 | >5.00 | |

All example lubricants dilute in 0% beer (sterile Milli-Q water) had no viable survivors and a greater than 5 log reduction at exposure times of 5 minutes or longer. When the example lubricants were diluted in 20% beer, it required up to 30 minutes to achieve a 5 log reduction in the microbial population. At shorter times Example 1D had a higher log reduction when compared to Example 1A, demonstrating the improved antimicrobial activity of formulas with the additives.

When diluted in 50% beer, Example 1A did not achieve a 5 log reduction at the maximum exposure of 60 minutes. Example 1B achieved a 5 log reductions at 60 minutes and Examples 1C and 1D achieved 5 log reductions at 30 minutes. Again demonstrating the improved antimicrobial efficacy of formulas with the additives of the invention.

The above specification, examples and data provide a complete description of the manufacture and use of the composition of the invention. Since many embodiments of the invention can be made without departing from the spirit and scope of the invention, the invention resides in the claims hereinafter appended.

We claim as our invention:

1. A method for suspending particulate matter and sanitizing the area of contact comprising the steps of:

(a) diluting a particulate suspending antimicrobial concentrate composition with a diluent, said concentrate composition comprising a carrier comprising a conveyor lubricant, an antimicrobial effective amount of a quaternary ammonium cationic compound, and an effective soil suspending amount of an amphoteric surfactant; and (b) applying the diluted concentrate composition to the intended area of application.

2. The method of claim 1 wherein said cationic compound comprises a quaternary ammonium salt.

3. The method of claim 2 wherein said quaternary ammonium salt is selected from the group consisting of an alkyl-trimethyl quaternary ammonium salt, a dialkyl dimethyl quaternary ammonium salt, an alkyl-aryl quaternary ammonium salt and mixtures thereof.

4. The method of claim 2 wherein said quaternary ammonium salt comprises an alkyl dimethyl benzyl ammonium chloride.

5. The method of claim 4 wherein said alkyl dimethyl benzyl ammonium chloride comprises about 0.1 wt-% to 25 wt-% of the composition.

6. The method of claim 1, wherein said surfactant comprises an amphoteric surfactant.

7. The method of claim 6 wherein said amphoteric surfactant comprises amino functionality and carboxyl functionality.

8. The method of claim 7 wherein said amphoteric surfactant comprises lauryliminodiproprionic acid, monosodium salt present in a concentration of about 0.1 wt-% to 30 wt-%.

9. A particulate suspending lubricant concentrate composition for use with a diluent, said concentrate comprising a carrier, said carrier comprising a conveyor lubricant, said conveyor lubricant comprising coco-1,3-diaminopropane, oleyl-1,3-diaminopropane or a mixture thereof said concentrate further comprising:

(a) from about 0.1 wt-% to 25 wt-% of an alkyl dimethyl benzyl ammonium chloride;

(b) from about 0.1 wt-% to 25 wt-% of aminopropionic or iminodipropionic fatty acid salts wherein said concentrate composition provides a sanitizing level of antimicrobial efficacy upon application to a diluent.

10. A lubricant composition resulting from the addition of a diluent to the composition of claim 9.

11. The composition of claim 10 wherein said diluent comprises water.

12. The concentrate composition of claim 9 wherein said alkyl dimethyl benzyl ammonium chloride composition is present in a concentration ranging from about 0.5 to 10 wt-% and said iminodipropionic fatty acid salt is present in a concentration ranging from about 0.5 to 10 wt-%.

13. The composition of claim 10 wherein the alkyl dimethyl benzyl ammonium chloride is present in a concentration ranging from about 5 to 2500 ppm and the iminodipropionic fatty acid-salt is present in a concentration ranging from about 5 to 3000 ppm.

14. The composition of claim 11 wherein the alkyl dimethyl benzyl ammonium chloride is present in a concentration ranging from about 5 to 2500 ppm and the iminodipropionic fatty acid-salt is present in a concentration ranging from about 5 to 3000 ppm,

15. The composition of claim 9 wherein the fatty acid salt is lauryl iminodipropionic acid-salt.

16. The composition of claim 9 which further comprises N-coco amine ethoxylate.

* * * * *